US006732816B2

(12) United States Patent
Dimitroff

(10) Patent No.: US 6,732,816 B2
(45) Date of Patent: May 11, 2004

(54) METHOD OF FORMING A TRENCHLESS FLOWLINE

(75) Inventor: Ted R. Dimitroff, Columbia, MO (US)

(73) Assignee: Lattice Intellectual Property Limited (GB)

( * ) Notice: Subject to any disclaimer, the term of this patent is extended or adjusted under 35 U.S.C. 154(b) by 0 days.

(21) Appl. No.: 09/812,070

(22) Filed: Mar. 19, 2001

(65) Prior Publication Data

US 2003/0094309 A1 May 22, 2003

Related U.S. Application Data

(60) Provisional application No. 60/201,387, filed on May 3, 2000.

(51) Int. Cl.[7] ..... E21B 47/022

(52) U.S. Cl. ..... 175/45; 175/53; 175/61; 175/62; 175/108; 175/135; 175/202; 405/184

(58) Field of Search ..... 175/45, 53, 61, 175/62, 108, 135, 162, 172, 202, 57; 405/184

(56) References Cited

U.S. PATENT DOCUMENTS

| | | | | | |
|---|---|---|---|---|---|
| 574,661 | A | * | 1/1897 | Carroll | 175/53 |
| 3,589,135 | A | | 6/1971 | Ede | 61/72.1 |
| 3,902,563 | A | * | 9/1975 | Dunn | 175/53 |
| 4,026,371 | A | * | 5/1977 | Takada et al. | 175/19 |
| 4,456,078 | A | * | 6/1984 | Adam | 175/20 |
| 4,542,796 | A | * | 9/1985 | Delbarre | 175/19 |
| 4,546,835 | A | * | 10/1985 | Williamson et al. | 173/20 |
| 4,578,871 | A | | 4/1986 | Kathel | 33/304 |
| 4,679,637 | A | | 7/1987 | Cherrington et al. | 175/61 |
| 4,691,788 | A | * | 9/1987 | Yoshida et al. | 175/202 |
| 4,696,607 | A | | 9/1987 | Ressi di Cervia | 405/267 |
| 4,706,388 | A | | 11/1987 | Van Steenwyk | 33/304 |
| 4,877,357 | A | | 10/1989 | Verstraeten | 405/267 |
| 4,894,923 | A | | 1/1990 | Cobern et al. | 33/304 |
| 4,953,638 | A | | 9/1990 | Dunn | 175/61 |
| 5,269,384 | A | | 12/1993 | Cherrington | 175/53 |
| 5,320,454 | A | | 6/1994 | Walling | 405/267 |
| 5,322,391 | A | | 6/1994 | Fisk | 175/73 |
| 5,363,926 | A | | 11/1994 | Mizuno | 175/45 |
| 5,427,475 | A | | 6/1995 | Coss | 405/184 |
| 5,456,552 | A | | 10/1995 | Cherrington | 405/184 |
| 5,687,805 | A | | 11/1997 | Perry | 175/53 |
| 5,711,381 | A | | 1/1998 | Archambeault et al. | 175/45 |
| 5,720,354 | A | | 2/1998 | Stump et al. | 175/26 |
| 5,758,730 | A | | 6/1998 | Derwand | 175/20 |
| 5,806,194 | A | | 9/1998 | Rodney et al. | 33/304 |
| 5,933,008 | A | | 8/1999 | Mercer | 324/326 |
| 5,979,570 | A | | 11/1999 | McLoughlin et al. | 175/24 |
| 5,984,583 | A | | 11/1999 | Craigmile et al. | 405/184 |
| 6,012,536 | A | | 1/2000 | Puttmann et al. | 175/21 |

OTHER PUBLICATIONS

Brinker and Minnick, The Surveyors Handbook, 1995, Chapman & Hall, 2nd edition, pp. 582–588.*

* cited by examiner

*Primary Examiner*—David Bagnell
*Assistant Examiner*—Giovanna Collins
(74) *Attorney, Agent, or Firm*—Stites & Harbison PLLC; Marvin Petry

(57) ABSTRACT

The present invention is an improved method of installing a flowline below the surface. The method includes the steps of establishing first and second sight relief holes along a linear path, positioning a directional drilling machine on the surface, boring a first portion of a pilot hole from the surface to the first sight relief hole, determining the elevation of the boring tool and adjusting the boring tool to the desired depth, boring a second portion of the pilot hole to the second relief hole, and determining the elevation of the boring tool and adjusting the tool to the desired depth. In another aspect of the invention, a method for directionally boring a flowline is provided. The method includes the steps of establishing a number of sight relief holes along the desired path of the bore, directionally drilling a pilot hole, reaming the material around pilot hole to define a bore wherein the bore is at least partially filled with a slurry of the reamed material, and pulling a pipe into the bore wherein a portion of the slurry is displaced into the sight relief holes so that pressure does not develop around the pipe.

11 Claims, 1 Drawing Sheet

METHOD OF FORMING A TRENCHLESS FLOWLINE

CROSS-REFERENCE TO RELATED APPLICATIONS

This application claims priority of U.S. Provisional Application No. 60/201,387, filed May 3, 2000.

STATEMENT REGARDING FEDERALLY SPONSORED RESEARCH OR DEVELOPMENT

Not Applicable.

BACKGROUND OF THE INVENTION

The present invention relates generally to a method for forming a flowline and, more particularly, to a method of directional boring a trenchless flowline bore using sight relief holes to set the proper grade and line and to prevent the pressure from building up about the pipe as it is placed within the flowline bore.

Proper installation of underground utilities such as storm sewer and sanitary sewer lines require boring a linear Bowline. It is desirable, and oftentimes mandatory, to install the flowline at a constant grade from one end of the flowline to the other. Ideally, once the flowline is completed, a lamp is shown at one end of the line. If the lamp is completely visible at the opposing end of the flowline, then a substantially constant grade has been maintained along the length of the flowline, and the flowline will effectively drain in the proper direction.

In the past, a number of methods have been used to install pipes with flowlines. The primary method of construction is open digging or trenching. To dig a flowline, a large trench is dug along the entire length of the line. Typically, a trench box is placed within the trench to protect workers located within the trench. The box is moved incrementally along the path of the flowline installation as the flowline is being built. Gravel and earth are placed around the pipe to maintain the location of the pipe, and the trench is subsequently back filled after the trench box is moved down the path of the flowline installation.

The open digging process suffers from a number of significant drawbacks. For instance, open trenches are hazardous for workers open digging the trench. It is possible for equipment and other objects to fall into the trench and strike workers therein. Also, it is common for large sections or clods of earth to dislodge and tumble into the open portions of the trench not protected by the trench box. Since soil typically weighs more than 100 pounds per cubic foot, even a small section may cause serious injury or death, particularly at the depths at which many flowlines are installed. Likewise, open trenches present an obvious danger to children and other bystanders.

The sheer size of the trench required for open digging also causes a number of problems. A great deal of time and effort is devoted to both digging and refilling each trench. Also, many digging locations, such as urban environments, simply do not have convenient locations at which the trenches may be dug. Additionally, the excess trench materials must be hauled away at the expense of the contractor or owner of the utility being installed.

Many other problems are associated with the open digging process. For instance, restoration of the site to its condition prior to installation of the flowline is difficult. It is particularly difficult to restore the continuity of the pavement and other ground conditions at the installation site.

Also, the costs are substantial to fill around the pipe with granular backfill to keep the pipe in place. Other problems include the difficulties associated with digging under inclement weather conditions, the negative environmental impact of the open digging process, expensive removal of water from the ground prior to digging, and the high fuel costs of operating open digging equipment.

Additionally, the impact on businesses and the local economy, environment and quality of life is great. Taking all of these negatives into consideration, other methods such as tunneling and auger boring are sometimes utilized for flowline installations. To install a flowline by tunneling, large pits are dug at the entrance and exit points, and the installing machine is located within the entrance pit. The machines may be operated either within the confines of the machine or remotely at the surface. In the tunneling method, the pipe is jacked into place within the bore by hydraulic rams as the tunneling equipment is used to cut the soil. At the end of the installation, the tunneling equipment is detached from the pipe and removed from the exit pit.

While the tunneling process overcomes some of the problems associated with open trenching, it too suffers from significant drawbacks. Since the tunneling equipment required to install smaller diameter bores is complex and expensive, it is uncommon for tunneling to be used for bores of less than three feet in diameter, and oftentimes cost prohibitive for bores having a diameter of less than two feet. Also, tunneling equipment is bulky and heavy, and cranes are commonly needed to lower the equipment into place. Moreover, a significant area must be set aside above ground for placement of the equipment used to guide the tunneling machine and recycle fluids during the tunneling process. Also, in the tunneling process, the pipe must have sufficient strength to withstand the forces of the hydraulic jacks. Steel and other pipe materials that have the strength to withstand these forces are susceptible to corrosion if used in acidic soil conditions, or as sewage or storm water drains. Thus, it is sometimes necessary to place a carrier pipe within the pipe installed by the tunneling method. This adds expense both during installation and maintenance of the flowline.

As mentioned above, auger boring has also been used as an alternative to open digging. Similar to the tunneling process, entrance and exit pits are dug at the endpoints of the desired line, and an auger machine is set into place within one of the pits. A cutting head is fastened to a length (or flight) of augers, and the augers are shoved through the pipe that is to be installed. Additional auger flights are added to the machine and pushed forward using a jacking process. as the bore is formed, the material from the bore hole is removed by the screw-like augers.

The most significant drawback to auger boring is the lack of guidance. Extreme care must be taken prior to setting up the auger boring machine to ensure that the machine is at the proper grade and line. In the auger boring process, a carrier pipe is required for two reasons. First, the pipe is located within the bore by a jacking process similar to tunneling, and must withstand the jacking forces. Secondly, the grade and line of the auger bore are oftentimes incorrect, and the carrier pipe is installed within the outer pipe to meet the required grade. In addition to these problems, installations of significant lengths require expert operators and are difficult to complete in a timely and consistent manner.

To address the problems of the aforementioned methods, directional drilling machines, such as those sold under the tradenames DITCHWITCH, VERMEER and CASE have been developed to directionally drill flowlines. A drilling machine is placed on the surface at a distance from the desired starting location of the bore. Downhole tooling is attached to a drill stem and drilled through the ground along a pilot hole from the surface of the ground to the desired starting location, and then along the path of the desired flowline. Additional sections of drill rods are added to the drill stem as the pilot hole is made. Electronic tracking components are disposed on the machine and downhole tool to guide the downhole tooling as the pilot hole is drilled. Once the pilot hole is complete, a hole opener such as a reaming head is placed on the machine and the pilot hole is backreamed to create the desired bore while the pipe is being pulled into place.

While the use of directional drilling machines eliminates many of the problems associated with open trenching, the machines also suffer some serious drawbacks. Namely, the electronic tracking components are not accurate enough to install the bores at the line and grade required for flowline bores. Thus, directional drilling machines are usually utilized for utilities that do not require very accurate line and grade, such as phones cables and pressure systems. Prior attempts to drill bores that require specific lines and grades are few, and the success rate has not been high. With current methods, when the flowline is drilled at a significant depth and/or the grade is relatively slight, the electronic tracking components simply can not control the tooling with the required precision.

Also, in the process currently used for directional boring, the dirt slurry remaining in the bore after the back reaming process is not always entirely pushed out of the ends of bore as the pipe is pulled into the bore. Consequently, a great deal of pressure is developed between the outer surface of the pipe and the bore sidewalls. This pressure can cause the pipe to collapse, pull apart or deflect from the intended line and grade. If the bore size is increased with respect to the diameter of the pipe to minimize pressure build-up, the pipe can float or deflect with respect to the desired centerline of bore, and the desired grade of the flowline pipe will not be achieved. When floating or deflection occurs, the flowline bore is quite likely to fail the lamping test, have high and low spots, and will not satisfy the requirements specified in the codes for proper installation of flowlines as dictated by local laws.

BRIEF SUMMARY OF THE INVENTION

The present invention is an improved method of installing a flowline below the surface utilizing directional boring. The method includes the steps of establishing first and second site relief holes along a linear path, positioning a directional drilling machine on the surface, boring a first portion of a pilot hole from the surface to the first sight relief hole, determining the elevation of the boring tool and adjusting the boring tool to the desired elevation, boring a second portion of the pilot hole to the second relief hole, and determining the elevation of the boring tool and adjusting the tool to the desired elevation.

In another aspect of the invention, a method for directionally boring a flowline is provided. The method includes the steps of establishing a number of sight relief holes along the desired path of the bore, directionally drilling a pilot hole, reaming the material around pilot hole to define a bore wherein a portion of the bore is filled with a slurry of the reamed material, and pulling a pipe into the bore wherein a portion of the slurry is displaced into the site relief holes so that pressure does not develop around the pipe.

By providing the methods in accordance with the present invention, numerous advantages are achieved. For instance, flowlines may be located with great accuracy, and at depths at which machines have been unsuitable heretofore. The disturbance at the construction site is lessened since fewer and smaller excavations are needed, and significantly less surface area is needed for the equipment. Moreover, less fuel is consumed in the methods of the present invention, and the overall social costs are reduced. Of great import, the working conditions are much safer for both workers and bystanders because of the reduction and near elimination of open excavation. The sight relief holes prevent pressure from building around the pipes to allow the flowline bore to be drilled at a diameter only slightly greater than the diameter of the pipe. This allows the pipe to be pulled in place accurately within the bore. Thus, the problems of pipe float or deflection can be avoided, and pipes may be placed at great depths and at very slight grades.

BRIEF DESCRIPTION OF THE DRAWINGS

The preferred embodiment of the present invention is described in detail below with reference to the attached drawings, wherein.

DETAILED DESCRIPTION OF THE INVENTION

Figure 1:
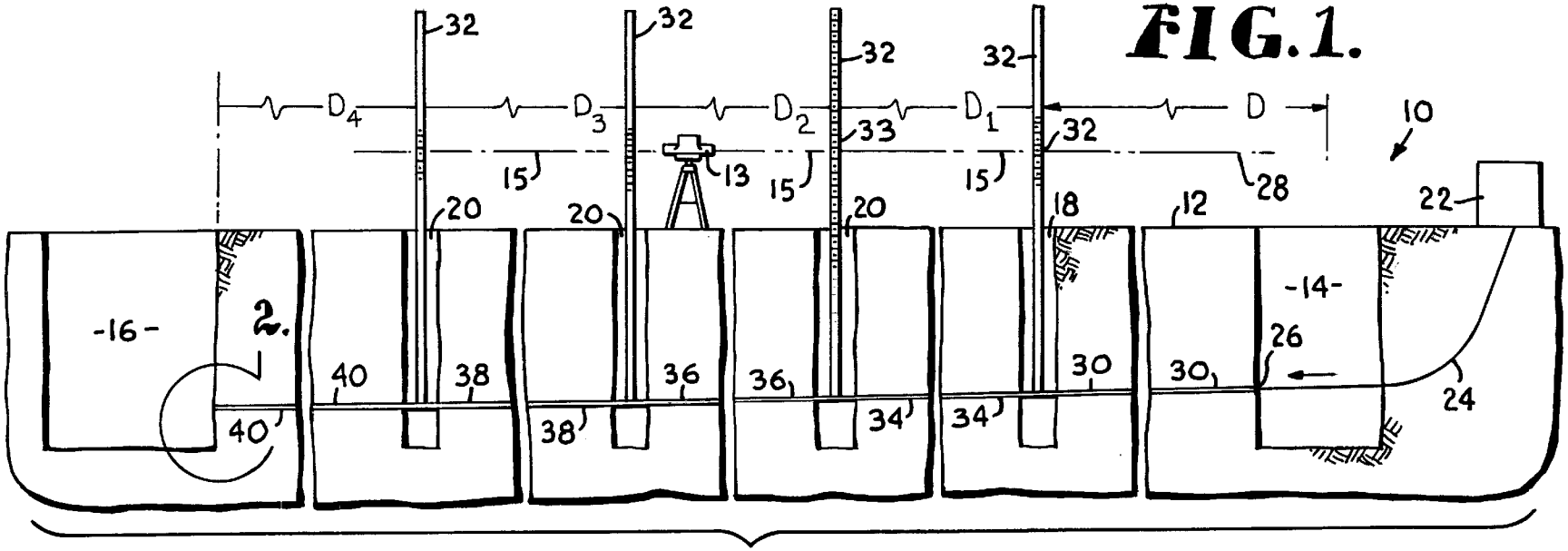
FIG. 1 is a schematic sectional view of a directional bore formed in accordance with the method of the present invention.

With reference to FIG. 1, the site at which the directional bore is to be drilled is designated generally by the reference numeral 10. First, the centerline of the underground bore is established with respect to the surface 12. Specifically, the linear direction of the bore is directly marked at the surface and the elevation (or depth) depth at which the bore is to be drilled is indicated at each of a number of points. In the preferred method, a transit or laser 13 is placed on the surface 12 is sighted along line 15 in either direction along the centerline direction of the bore at selected points. The grade of the flowline bore is reflected by marking the depth of the centerline of the bore with reference to the level of the line 15. A pipe drop allowance is factored into determining the centerline measurements depending upon the size of the pipe and the material from which the pipe is made. Other conventional techniques for determining the direction and depth of the center line of the flowline bore may be employed such as by marking grade reference points on stakes or spray painting the reference information directly onto the ground surface at each of the selected points.

Next, a first hole 14 is dug from the surface 12 at the desired initial point of the flowline bore. A second hole 16 is dug from the surface above the desired terminal point of the bore. A number of sight relief holes are excavated between the first and second holes along the line indicated on the surface, preferably at the selected points at which the depth of flowline bore is indicated at the surface. Specifically, a first sight relief hole 18 is excavated at a distance DI from the center of first hole 14, and each of the remaining sight relief holes 20 are positioned at the distance $D_2$, $D_3$ . . . $D_f$ from the preceding sight relief hole. Preferably, the distances between each of sight relief hole are equal to one another, and the distance $D_f$ between the final sight relief hole and the second hole 16 is less than the distance between each of the sigh relief holes. The actual distance between sight relief holes varies with each project depending on the desired grade of the flowline. Typically, for a less severe grade, the sight relief holes are positioned closer to one another. For instance, a typical distance between sight relief holes for flowline having a grade of 0.5% is between fifty to a hundred feet. When the desired grade is significantly steeper, the distance between the sight relief holes may be increased while equidistant sight relief holes embody the preferred embodiment of the present invention, the holes may be placed at irregular distances from one another. For instance, when the flowline is to be installed under an obstruction such as a road or building, the sight relief holes may be placed on either side of the structure departing from the pattern of the holes not affected by the obstruction.

Each sight relief hole is established by drilling, digging or otherwise excavating vertically to a depth of about one foot below the desired centerline of the pipe, although greater or lesser depths may be desired in some cases. For instance, if the pipe is to be placed at a depth of twenty-five feet at a particular point, the sight relief hole at that point is excavated to about twenty-six feet. The diameter of the sight relief holes is determined by the soil conditions of the ground at the site 10. If a pipe having a twelve inch diameter is to be placed within the directional bore, the sight relief holes typically have a diameter of between twelve to sixteen inches, although other sizes may be utilized. In the preferred method, once the sight relief holes have been formed, a soft material pipe is placed within the holes to hold the holes open while the flowline bore is drilled as described below. Alternatively, a hard material pipe may be placed in the sight relief holes due to soil conditions or other sight specific reasons. Typical soft pipe materials include polyvinyl chloride (PVC), high density polyethylene (HDPE), low density polyethylene (LDPE) or cardboard tube pipe. Typical hard pipe material would include steel or concrete.

Prior to or after the sight relief holes have been excavated, a directional boring machine 22 is setup on surface 12. The directional boring machine has electronic guide means for controlling the position of the bore stem under the surface of the ground. The machine is placed at a sufficient distance from the first hole 14 so that the downhole tooling on the bore stem (or downhole tooling) may be drilled to the desired depth at which the directional bore is to begin. Initially, a pilot hole is drilled along the line schematically indicated by line 24. When the bore stem of the boring machine 22 reaches initial point 26 at hole 14, the position of the bore stem is checked. Preferably, the depth and line of the bore stem is measured with respect to the laser beam 28 emanating from transit 13. If the electronic control means of the directional boring machine 22 are not exactly correct and the bore stem is not in the proper position, adjustments are made to reposition the stem at the proper depth and center line. Also, the grade of the downhole tooling is checked and adjusted to match the desired grade of the flowline.

Next, the downhole tool affixed to the bore stem of the boring machine 22 travels along the path indicated by numeral 30 until reaching the first sight relief hole 18. The diameter of the hole is preferably about four inches. When the bore stem reaches first sight relief hole 18, a pole 32 having markings or graduations 33 is placed within the first sight relief hole 18. The pole is used to determine the elevation of the downhole tool and bore stem. In the preferred method, the pole is used to measure the distance between the downhole tooling of the bore stem and the beam 15 to ensure that the grade of the flowline bore is proper. If the bore stem is not at the desired depth and along the proper line, the relevant adjustments are made using the controls on the machine. Specifically, the center of the bore stem is oriented at the proper depth and the proper line so that the pilot hole (and ultimately the flowline bore) is precisely positioned.

The process is continued at each successive sight relief hole 20 so that the bore stem is directed along the proper paths indicated by lines 34, 36 and 38 in FIG. 1. Since the line and depth of the bore stem is precisely adjusted to the proper position at each successive sight relief hole, the slight displacement of the bore stem that occurs between each sight relief hole is not compounded, and an extremely accurate path is defined. Finally, the bore stem is directed along the path indicated by line 40 from the last sight relief hole to the terminal hole 16.

Figure 3:
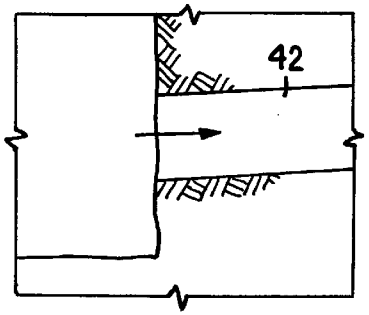
FIG. 3 is an enlarged sectional view of the reamed out bore after the second step of the present invention.
Figure 2:
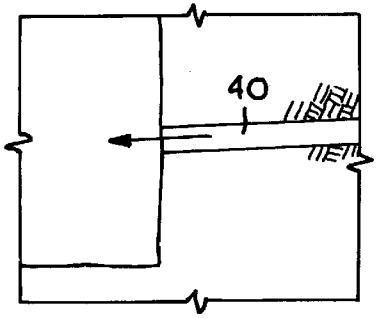
FIG. 2 is an enlarged sectional view of the stem bore, placed in the ground during the first step of the method of the present invention.

With reference to FIG. 2, the pilot hole is shown at terminal hole 16. At this point, a conventional pre-reaming head is placed on the end of the bore stem. Typically, the pre-reaming head is slightly larger than the outer diameter of the pipe to be placed within the bore. For instance, if the flowline pipe to be placed in the bore is twelve inches in diameter, the pre-reaming head typically has a diameter of about twelve and one-half inches. The pre-reamer is pulled back through the pilot hole toward initial hole 14 in the direction of the arrow in FIG. 3 to form a bore indicated schematic as numeral 42. During the pre-reaming process, the soil is mixed into a slurry by the injection of an aqueous solution water (and boring fluids, concentrates and/or polymers) at the pre-reaming head. The aqueous solution typically consists of water, boring fluids, concentrates, and/or polymers as is known in the art. The solution mixes with the soil so that it will flow and fill around the pipe. This allows the pipe to be pulled in with less resistance and eliminates voids around the pipe as described below.

Figure 4:
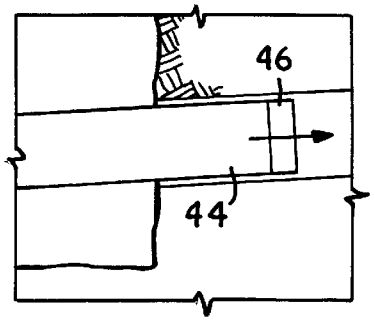
FIG. 4 is an enlarged sectional view of the drainage pipe being pulled into the reamed out bore in accordance with the final step of the present invention.

The tooling is conventional for use with directional drilling machines, and is known to those of skill in the art. Namely, once the bore stem reaches the initial hole 14, the pre-reaming head is removed and a pushback cap is placed on the bore stem. The pushback cap is directed through pre-reamed hole 42 from initial hole 14 to terminal hole 16. Finally, as shown in FIG. 4, a pull cap is connected to the pipe and the pipe is pulled through the hole 42. As the pull cap 46 (shown schematically in FIG. 4) is pulled through the hole, the soil slurry is pushed by the pull cap and pipe 44 into the sight relief holes to relieve the pressure between the bore sidewalls and the pipe. Once the pipe is in place, the unfilled portion of the sight relief holes are filled with gravel or other suitable material.

The foregoing methods are more accurate than relying upon the electronic directional means of the directional boring machine alone, and allow for flowline bores having grades as slight as 0.2% to be installed on a consistent basis since the pilot hole path is drilled with great precision. Also, the problems of accuracy of the machines at great depths are avoided by the use of the sight relief holes. Moreover, large diameter pipes may be drilled with accuracy using the methods of the current invention since pressure is relieved at each of the sight relief holes when the pipe is pulled into the flowline bore. Since the bore diameter does not have to greatly exceed the pipe diameter, the problems related to pipe float are similarly avoided.

Thus, flowlines only reasonably feasible through open digging techniques may be directionally drilled without all the problems of safety, expense, environmental impact and impracticability as set forth above.

While the methods are described with reference to storm water and sewer lines, the methods may be used for any process wherein a directional bore is desired. For instance, the process may be used for placement of fiberoptic cables underground in places previously presenting cost prohibitive obstacles and for longer length single bores.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A method of drilling a flowline below the surface, the method comprising the steps of:

establishing a first sight relief hole and a second sight relief hole along the linear path;

positioning a directional drilling machine on the surface, the directional drilling machine having a boring tool, the position of the boring tool relative to the surface being variable under the control of the directional drilling machine;

boring a first portion of a pilot hole from the surface to the first sight relief hole;

determining the elevation of the tool at the first sight relief hole;

adjusting the position of the tool at the first sight relief hole to a first desired depth;

boring a second portion of the pilot hole from the first sight relief hole to the second sight relief hole;

determining the elevation of the tool at the second sight relief hole; and adjusting the position of the boring tool to a second desired depth, the second desired depth being different from the first desired depth.

2. The method of claim 1 further comprising:

reaming the pilot hole;

providing a pipe; and locating the pipe.

3. The method of claim 1 wherein the position of the boring tool is determined by placing a measuring device within the first or second sight relief hole and measuring the depth of the tool.

4. The method of claim 3 wherein the depth of the tool is measured with reference to a laser beam, the laser beam emitted from a transit located on the surface.

5. The method of claim 4 wherein each sight relief hole is generally vertical.

6. The method of claim 1 further comprising:

establishing a third sight relief hole;

boring a third portion of the pilot hole to the third sight relief hole;

determining the position of the boring tool at the third sight relief hole, and adjusting the position of the boring tool.

7. The method of claim 6 wherein the second sight relief hole is equidistant from the first and third sight relief holes.

8. A method for directionally boring a flowline, the method comprising the steps of:

establishing a number of sight relief holes along the desired path of the bore;

directionally drilling a pilot hole;

checking the depth of the pilot hole at each sight relief hole prior to drilling to the next sight relief hole on the linear path;

reaming the material around the pilot hole to define a bore, the bore at least partially filled with a slurry of the reamed material, and pulling a pipe into the bore wherein a portion of the slurry is displaced into the sight relief holes so that pressure does not develop around the pipe.

9. The method of claim 8 wherein the sight relief holes are generally vertical.

10. The method of claim 9 wherein the sight relief holes are spaced at equal distances from one another.

11. The method of claim 10 wherein the diameter of each sight relief hole is greater or smaller than the diameter of the bore.

* * * * *